United States Patent [19]

Azar et al.

[11] 4,372,246

[45] Feb. 8, 1983

[54] EXTERNALLY HEATED FUSING MEMBER FOR ELECTROSTATOGRAPHIC COPIERS

[75] Inventors: Jack C. Azar, Rochester; Arnold W. Henry, Pittsford; Robert M. Ferguson, Penfield, all of N.Y.

[73] Assignee: Xerox Corporation, Stamford, Conn.

[21] Appl. No.: 260,649

[22] Filed: May 4, 1981

[51] Int. Cl.[3] ..... B05C 11/00

[52] U.S. Cl. ..... 118/60; 29/132; 156/330; 219/216; 355/3 FU; 427/407.1; 427/409; 427/410; 432/60

[58] Field of Search ..... 118/60; 355/3 FU; 401/21, 208, 218, 219, 220; 427/386, 387, 407.1, 410, 409; 156/110 R, 330; 29/132; 432/60; 219/216

[56] References Cited

U.S. PATENT DOCUMENTS

| | | | |
|---|---|---|---|
| 3,452,181 | 6/1969 | Styjewski | 219/216 |
| 3,498,596 | 3/1970 | Moser | 263/6 |
| 3,912,901 | 10/1975 | Strella et al. | 219/216 |
| 3,967,042 | 6/1976 | Laskin et al. | 428/422 |
| 4,071,735 | 1/1978 | Moser | 219/216 |
| 4,074,001 | 2/1978 | Imai et al. | 29/132 X |
| 4,078,286 | 3/1978 | Takiguichi et al. | 29/132 |
| 4,083,092 | 4/1978 | Imperial et al. | 29/132 |
| 4,149,797 | 4/1979 | Imperial et al. | 355/3 FU |
| 4,257,699 | 3/1981 | Lentz | 355/3 FU |

*Primary Examiner*—John D. Smith
*Assistant Examiner*—Thurman K. Page

[57] ABSTRACT

In an externally heated fusing system, the improvement which comprises providing an externally heated fuser member which is made of a base, a relatively thick layer of a foam of a fluoroelastomer on the base, and a relatively thin layer of a silicone elastomer on the foam layer. The silicone elastomer layer containing an iron oxide filler therein.

23 Claims, 2 Drawing Figures

EXTERNALLY HEATED FUSING MEMBER FOR ELECTROSTATOGRAPHIC COPIERS

This invention relates to a novel externally heated fusing member for use in electrostatographic copying machines.

BACKGROUND OF THE INVENTION AND PRIOR ART STATEMENT

As indicated in U.S. Pat. No. 4,078,286, in a typical process for electrophotographic duplication, a light image of an original to be copied is recorded in the form of a latent electrostatic image upon a photosensitive member, and the latent image is subsequently rendered visible by the application of electroscopic particles, which are commonly referred to as toner. The visible toner image is then in a loose powdered form and it can be easily disturbed or destroyed. The toner image is usually fixed or fused upon a support, which may be the photosensitive member itself or another support such as a sheet of plain paper. The present invention relates to the fusing of the toner image upon a support.

In order to fuse electroscopic toner material onto a support surface permanently by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

The use of thermal energy for fixing toner images onto a support member is well known. Several approaches to thermal fusing of electroscopic toner images have been described in the prior art. These methods include providing the application of heat and pressure substantially concurrently by various means: a roll pair maintained in pressure contact; a flat or curved plate member in pressure contact with a roll; a belt member in pressure contact with a roll; and the like. Heat may be applied by heating one or both of the rolls, plate members, or belt members. The fusing of the toner particles takes place when the proper combination of heat, pressure and contact time are provided. The balancing of these parameters to bring about the fusing of the toner particles is well known in the art and they can be adjusted to suit particular machines or process conditions.

During the operation of a fusing system in which heat is applied to cause thermal fusing of the toner particles onto a support, both the toner image and the support are passed through a nip formed between the roll pair, or plate, or belt members. The concurrent transfer of heat and the application of pressure in the nip effects the fusing of the toner image onto the support. It is important in the fusing process that no offset of the toner particles from the support to the fuser member takes place during normal operations. Toner particles offset onto the fuser member may subsequently transfer to other parts of the machine or onto the support in subsequent copying cycles, thus increasing the background or interfering with the materials being copied there. The so called "hot offset" occurs when the temperature of the toner is raised to a point where the toner particles liquify and a splitting of the molten toner takes place during the fusing operation. "Cold offset" may be caused, even at the temperatures below the molten point of the toner, by such factors as imperfections in the surface of the fusing members; by the toner particles being insufficiently adhering to the support; by electrostatic forces which may be present; etc.

Another problem frequently encountered in fusing with a heated member is that the substrate, e.g. a sheet of paper, on which the toner image is fused may curl and/or adhere to the heated fuser. Such adhering paper will tend to wrap itself around the fuser and thus prevent the fuser from performing its intended operations in subsequent copying cycles. Such adhering paper must be generally removed by hand, resulting in much manual labor and machine downtime.

Another feature common to most of the prior art fusing members is that the source of the heat energy for the fusing operation is generally in the form of a quartz lamp positioned in the core of a fuser roll. In such a configuration, the heat must be conducted from the core of the fuser member, through the various layers of materials comprising the fuser member, to the surface of the fuser member for transfer to the toner image and its substrate. To obtain the proper fusing temperature at the surface of such a fusing member, it can be readily appreciated that the temperatures at the various layers or points within the fuser member must be substantially higher. Moreover, since heat must be transmitted from the source in the core of the fuser member to its surface, it takes an appreciable amount of time before the surface of the fusing member is warmed up to the fusing temperature and thus ready for operations. This delay in readiness of the machine to fuse toner images, or the warmup time, is accentuated by the fact that such fuser members are generally made of elastomeric or other polymeric materials which are generally poor conductors of heat.

In U.S. Pat. No. 3,452,181, here is disclosed a roll fusing device which is heated by both an internal heating element and an external auxiliary heating element. The fusing drum of this patent is made of a glass or quartz sleeve having a transparent silicone varnish layer thereon and offset-preventing silicone oil is applied to the surface of the silicone varnish layer.

U.S. Pat. No. 3,498,596 discloses a heat fixing apparatus in which the pressure roll is made of a metallic cylinder having a coating of Teflon thereon, and in which the heated roll is made of a metallic cylinder having a heat insulating silicone rubber blanket thereon. The silicone rubber blanket has a thin coating of a reflective release agent applied thereto.

In U.S. Pat. No. 3,912,901, there is disclosed a PFA Teflon sleeved pressure roll. The pressure roll is made of a thick elastomeric layer of heatresistant silicone rubber, with a thin sleeve of a high flex life fluorinated ethylene propylene (FEP) sleeve thereon. The fuser roll of this patent is made of a rigid cylinder coated with a fluorocarbon polymer layer (such as tetrafluoroethylene).

U.S. Pat. No. 3,967,042 discloses a fuser blanket for use in an internally heated fusing roller, which is made of a heat conductive backing, a fluorinated elastomer layer and a thin silicone elastomer overlayer.

In U.S. Pat. No. 4,071,735, there is disclosed an externally heated roll fuser, in which the heating element heats the fuser roll at the same time preheats the toner image to be fused. The fuser roll of this patent is made of a metallic core with a layer of heat insulating silicone rubber thereon.

U.S. Pat. No. 4,083,092 discloses a sleeved organic rubber pressure roll, which is made of a thick layer of a resilient organic rubber on a metallic core. The thick organic rubber layer has an outer sleeve of Teflon or similar material to prevent the oxidation degradation of the thick organic rubber layer. The fuser roll of this patent is made of a thick metallic core with a layer of Teflon or similar material on its surface.

U.S. Pat. No. 4,149,797 discloses a sleeved organic rubber pressure roll which, for the purposes of the present invention, is essentially similar to that disclosed in U.S. Pat. No. 4,083,092 mentioned above.

It is an object of the present invention to provide an improved externally heated fuser roll.

It is another object of the present invention to provide an externally heated fuser roll which is energy efficient, produces copies of high quality, as well as possessing superior release properties.

Other objects of the invention can be gathered from the following detailed disclosure.

SUMMARY OF THE INVENTION

The above objects are accomplished in accordance with the present invention by providing an externally heated fuser member which is made of a base, a relatively thick layer of a foam of fluoroelastomer on the base and a relatively thin layer of a silicone elastomer on the foam layer. The silicone elastomer layer has an iron oxide filler dispersed therein. The iron oxide filler is both an efficient absorber of the externally supplied energy as well as providing strength to the abhesive silicone elastomer.

DETAILED DESCRIPTION OF THE INVENTION

Figure 1:
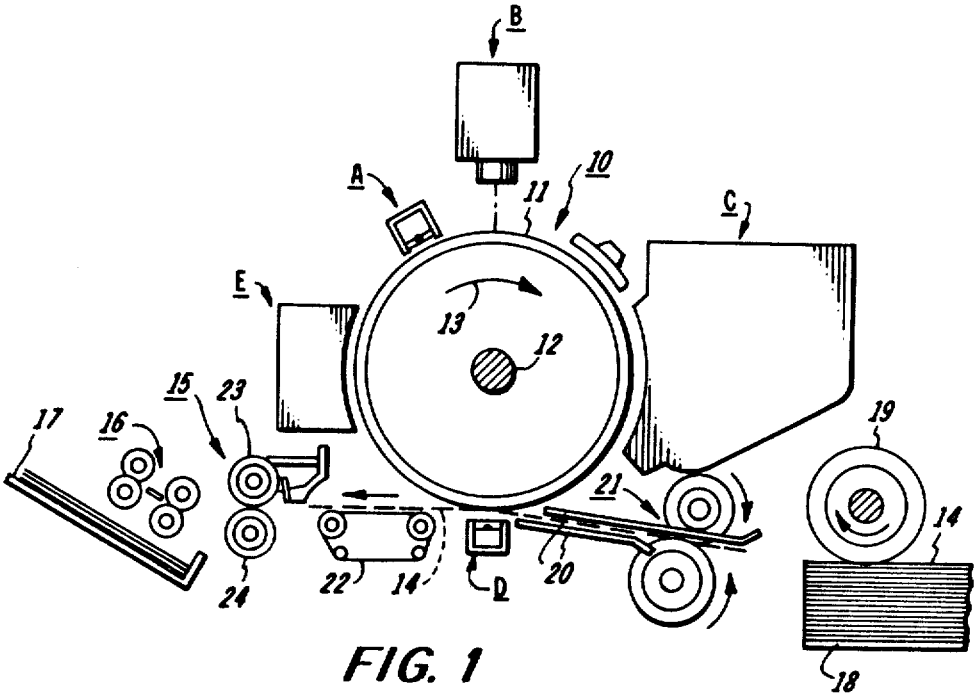
FIG. 1 is a schematic representation of an electrostatographic reproducing apparatus incorporating the externally heated fuser member of the present invention.

FIG. 1 illustrates the major components in an electrostatographic reproducing machine, and it is essentially similar to that illustrated in FIG. 1 of said Moser U.S. Pat. No. 4,071,735. Briefly, a drum-like member 10 having a layer of a suitable photoconductive insulating material 11 on its outer periphery is mounted on a shaft 12 for rotation in the clockwise direction as indicated by arrow 13 to bring the surface of drum member 10 past several stations illustrated in block diagram form. At station A the photoconductive insulating surface of drum member 10 is given a uniform electrostatic charge, for example by a corona generating device. The charged portion of the drum member 10 is then rotated to station B where it is exposed to a light image of the original document or other information to be copied. This exposure selectively dissipates the charges in the exposed regions of the photoconductive insulating surface to result in a latent electrostatic image. This latent electrostatic image is then developed at station C, for example by a conventional cascade type of development or a magnetic brush development system. The developed image then passes to station D where the developed toner image is transferred to a support or substrate 14. A supply of the support 14 is stored in a container 18. The support 14 is individually fed from the container 18 by a feed roller 19 through registration rollers 21 and guide members 20 to transfer station D. At transfer station D, the developed toner image is transferred from the drum member 10 to the support 14 and transported to a fuser assembly 15 by transport means 22. At fuser assembly 15, the powder toner image on support 14 is fused to the support by the application of the heat and pressure from a fuser roll 23 and a backup roll 24. Thereafter, the support 14 bearing the fused toner image is advanced by rolls 16 to a copy paper tray 17. Referring to the photoconductive insulating surface 11 of the drum member 10, it is passed to a cleaning station E after the developed image has been transferred to support 14 at station D. At cleaning station E, the surface 11 is cleansed of residual toner particles to prepare the surface for the next copying cycle. This mode of operation in an electrostatographic reproducing machine is known to the art. The present invention is concerned with the fuser assembly 15, and more particularly to the makeup of the fuser roll 23.

The fuser roll 23 of the present invention is intended to be used in an externally heated fusing system. The external heat source may be a quartz lamp such as that illustrated in FIG. 5 of said Moser U.S. Pat. No. 4,071,735.

Figure 2:
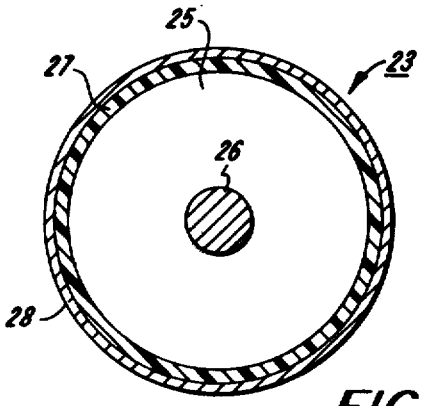
FIG. 2 is a cross-sectional view of the fuser member of this invention.

Referring to FIG. 2, the fuser roll 23 is shown in a cross-sectional view. The fuser roll 23 is made of a core or base 25 which may be in the form of a cylinder mounted on a shaft 26 for rotation. The core 25 is essentially rigid and may be made of such metals as copper, aluminum or steel. In accordance with the present invention, the surface of core 25 is coated with a layer 27 of a foam of a fluoroelastomer. A layer 28 of a silicone elastomer having an iron oxide filler dispersed therein is coated on the outer surface of layer 27.

In a fuser assembly in which the fuser roll is heated by external heating means, that is a fuser roll not having the heating element disposed in its interior as illustrated in FIG. 2 of said Imperial U.S. Pat. No. 4,149,797, several requirements must be met for successful fusing operations. Surprisingly, the fusing member of the present invention is a very efficient absorber of heat while it dissipates relatively small amounts of heat to the surroundings. Moreover, the fusing member of the present invention is conformable, that is forming a nip which is desirable in the production of high quality copies, and its surface has release properties which aid in the prevention of offsetting of the toner particles. These and other advantages make the fusing member of the present invention outstandingly suited for use in an externally heated fuser assembly.

As indicated above, the layer 27 is composed of a foam of a fluoroelastomer. A particularly preferred fluoroelastomer is a family of copolymers of vinylidene fluoride and hexafluoropropylene and a family of terpolymers of vinylidene fluoride, hexafluoropropylene and tetrafluoroethylene, both marketed by the DuPont Company under its trade name Viton. These fluoroelastomers are high temperature resistent and they are thermal insulators. When they are fabricated in the form of a foam, they are extremely good thermal insulators and yet able to withstand very high temperatures. In addition, the foam is conformable and it will provide a suitable nip for the production of high quality copies. The thickness of the foam layer may be varied, but we have found that a foam layer of about 30 to 100 mils in thickness is very suitable. More particularly, we have found that a foam layer of about 80 mils in thickness to be preferred.

The layer 28 of silicone elastomer may be made of room temperature vulcanizable (RTV) silicone material. These include, for example, disilanols such as an $\alpha,\omega$-hydroxy polydimethylsiloxane. A family of such disilanols are available from the Rhone-Poulenc Company under its trade designation Rhodorsil. As indicated above, the silicone elastomer layer 28 is to be filled with an iron oxide filler. The iron oxide should be finely divided and may be used in an amount about 10 to 30 parts by weight per 100 parts by weight of the silicone elastomer. The iron oxide is an efficient absorber of infrared energy and it is also a reinforcing agent in the composition. The iron oxide improves the mechanical strength and the swell characteristics of the silicone elastomer when the fuser member is used with typical release agents. The layer 28 is preferably made to be about 3 to 12 mils in thickness. More preferably, the layer 28 is about 10 mils in thickness. A cross linking agent and a cross linking catalyst are preferably used in the silicone formulation, along with the iron oxide for preparing the silicone elastomer layer 28. Such cross linking catalysts and the cross linking agents are known to those skilled in the art. An example of a preferred cross linking agent is tetraethylorthosilicate, and an example of a preferred cross linking catalyst is dibutyltin diacetate.

The iron oxide filler should be in a finely divided form, having a particle size in the range of submicron up to about 1-3 microns. In particular, we prefer to use a commercially available iron oxide, Mapico Red 297, having an ultimate particle size of about 0.4 micron. The iron oxide filler also may be partially replaced by carbon black. For example, the filler in the silicone elastomer may be 10% by weight iron oxide, based on the weight of the silicone elastomer present, or it may be composed of 5% iron oxide and 5% carbon black.

The invention will now be described with reference to the following Examples.

EXAMPLE I

A fuser member, for use in an externally heated fuser assembly in accordance with the present invention, was prepared by using a core composed of a cylinder of aluminum about 2 inches in diameter. The surface of the core was grit blasted and a Viton E 60C formulation, obtained from the Dupont Company, was sprayed onto the core. A 26 mil thick Viton layer was coated onto the core. Thereafter, a silicone elastomer formulation was prepared by mixing 100 parts by weight of a dimethylsiloxanediol, about 5 parts by weight of a finely divided iron oxide, about 5 parts by weight of a finely divided carbon black, and about 15 parts by weight of tetraethylorthosilicate. This mixture was mixed in a ball mill, and the viscosity of the mixture was adjusted to 80 centistokes (Cstk) by the addition of methyl ethyl ketone solvent. Then about 0.5 part by weight dibutyltin diacetate was added and mixed with the formulation. The formulation was then sprayed onto the Viton coated roll by the use of a Binks spraying unit. The spray coated roll was dried for 17 hours at 125° F. and then oven cured at 350° F. for 3 hours. This roll, which does not have a foamed Viton underlayer, is designated as the control. This resulted in a silicone layer about 7.5 mils thick.

EXAMPLE II

The procedure of Example I was repeated except that after the core was grit blasted, two coats of Thixon adhesive, available from the Whittaker Corporation, were applied to the core. A closed cell Viton foam, obtained from Industrial Electronic Rubber Company in a sheet form, was then wrapped to the core. The bonding of the foam to the core was completed by oven curing the Thixon adhesive for two hours at 350° F. Thereafter, the thickness of the Viton foam was adjusted by grinding in a grinder, to about 82 mils. The silicone elastomer formulation of Example I was then applied to this Viton foam coated roller, to a thickness of about 9 mils.

EXAMPLE III

The procedure of Example II was repeated except that the silicone elastomer formulation used contained 10 parts by weight of a finely divided iron oxide in place of the 5 parts iron oxide and 5 parts carbon black of Example II.

EXAMPLE IV

The three fuser rolls made in accordance with Examples I-III were placed in a laboratory testing device in which the fuser roll is in contact with a PFA coated pressure roll. A 1465 watt quartz lamp, 120 volts, obtained from Sylvania, was held at a distance of about 2 inches from the surface of the fuser roll. The surface temperature of the fuser roll was then measured at a point not directly visible to the quartz lamp, with a thermocouple device. The surface temperatures so obtained were as follows:

| | Temperature °F. | | |
|---|---|---|---|
| Time (minutes) | Roll of Example I | Roll of Example II | Roll of Example III |
| 0 (at start) | 75 | 75 | 75 |
| 1 | 105 | 203 | 160 |
| 3 | 145 | 240 | 234 |
| 6 | 200 | 262 | 254 |
| 9 | 270 | 262 | 257 |

While the invention has been described in detail with reference to the specific and preferred embodiments, it will be appreciated that various modifications may be made from the specific details without departing from the spirit and scope of the invention.

What is claimed is:

1. An externally heated fuser member for use in an electrostatographic copying machine for fusing toner images to substrates comprising:

a base;

a relatively thick layer of a foam of a fluoroelastomer on said base; and a relatively thin layer of a silicone elastomer on said foam layer, said silicone elastomer having an iron oxide filler dispersed therein.

2. An externally heated fuser member according to claim 1 wherein said foam layer is between about 30 to 100 mils thick, and wherein said silicone elastomer is between about 3 to 20 mils thick.

3. An externally heated fuser member according to claim 1 wherein said iron oxide is present in an amount about 10 to 30 parts by weight per 100 parts by weight of silicone elastomer.

4. An externally heated fuser member according to claim 1 wherein said foam layer is about 80 mils thick and made of poly (vinylidene fluoride -hexafluoropropylene) or poly (vinylidene fluoride-hexafluroropropylene-tetrafluoroethylene).

5. An externally heated fuser member according to claim 1 wherein said silicone elastomer layer is about 10 mils thick and made of a composition comprising about 100 parts by weight of a polysiloxane, about 5 parts by weight iron oxide, and about 5 parts by weight carbon black.

6. An externally heated fuser member according to claim 5 wherein said polysiloxane is an $\alpha$, $\omega$-hydroxy polydimethylsiloxane.

7. An externally heated fuser member according to claim 5 wherein said polysiloxane is a mixture of a polydimethylsiloxane and a polymethylhydrosiloxane.

8. An externally heated fuser member according to claim 5 wherein said composition further comprising a crosslinking agent and a crosslinking catalyst.

9. An externally heated fuser member according to claim 8 wherein said crosslinking agent is tetraethylorthosilicate and wherein said crosslinking catalyst is dibutyltin diacetate.

10. An externally heated fuser member according to claim 1 wherein said foam layer is about 80 mils thick and made of poly (vinylidene fluoride-hexafluoropropylene-tetrafluoroethylene), and wherein said silicone elastomer layer is about 10 mils thick and made of a composition comprising about 100 parts by weight an $\alpha$, $\omega$-hydroxy polydimethylsiloxane, about 5 parts by weight iron oxide, about 5 parts by weight carbon black, about 15 parts by weight tetraethylorthosilicate, and about 0.5 parts by weight dibutyltin diacetate.

11. An externally heated fuser member according to claim 1 wherein said foam layer is about 80 mils thick and made of poly (vinylidene fluoride-hexafluoropropylene-tetrafluoroethylene), and wherein said silicone elastomer layer is about 10 mils thick and made of a composition comprising about 100 parts by weight of a mixture of polydimethylsiloxane and polymethylhydrosiloxane, about 5 parts by weight iron oxide and about 5 parts by weight carbon black.

12. A method for making the externally heated fuser member of claim 1 which comprises:

providing a base;

applying a layer of foamed fluoroelastomer onto said base;

applying to said foamed layer a composition comprising a polysiloxane and iron oxide; and curing said formulation in situ to form said silicone elastomer layer and to cause said silicone elastomer layer to be bonded to said foamed layer.

13. A method according to claim 12 wherein said foamed layer is applied to said base with an adhesive coated on said base.

14. A method according to claim 13 wherein said adhesive is an epoxy adhesive.

15. A method according to claim 12 wherein said polysiloxane comprises a mixture of a polydimethylsiloxane and a polymethylhydrosiloxane.

16. A method according to claim 12 wherein said polysiloxane comprises an $\alpha$, $\omega$-hydroxy polydimethylsiloxane, and wherein said composition further comprises a crosslinking agent and a crosslinking catalyst.

17. A method according to claim 16 wherein said crosslinking agent is tetraethylorthosilicate and wherein said crosslinking catalyst is dibutyltin diacetate.

18. In a fuser assembly for use in an electrostatographic copying machine for fusing toner images to substrates, which includes a fuser member, a pressure member and a heating element located externally of said fuser member, the improvement which comprises said fuser member being made of:

a base;

a relatively thick layer of a foam of a fluoroelastomer on said base; and a relatively thin layer of a silicone elastomer on said foam layer, said silicone elastomer having an iron oxide filler dispersed therein.

19. A fuser assembly according to claim 18 wherein said fluoroelastomer is poly (vinylidene fluoride-hexafluoropropylene) or poly (vinylidene fluoride-hexafluoropropylene-tetrafluoroethylene), and wherein said silicone elastomer comprises a disilanol.

20. An externally heated fuser member for use in an electrostatographic copying machine for fusing toner images to substrates comprising:

a base;

a relatively thick fluoroelastomer foam layer on said base made of poly (vinylidene fluoride-hexafluoropropylene) or poly (vinylidene fluoride-hexafluoropropylene-tetrafluoroethylene); and a relatively thin layer of a polysiloxane elastomer on said foam layer, said polysiloxane elastomer having an iron oxide filler dispersed therein, said iron oxide being present in said thin layer in an amount about 10 to 30 parts by weight per 100 parts by weight of said polysiloxane.

21. An externally heated fuser member according to claim 20 wherein said foam layer is between about 30 to 100 mils thick, and wherein said polysiloxane elastomer is between about 3 to 20 mils thick.

22. An externally heated fuser member according to claim 21 wherein said polysiloxane is an $\alpha\omega$-hydroxy polydimethylsiloxane.

23. An externally heated fuser member according to claim 21 wherein said polysiloxane is a mixture of a polydimethylsiloxane and a polymethylhydrosiloxane.

* * * * *